United States Patent [19]

Grimm et al.

[11] 4,179,108

[45] Dec. 18, 1979

[54] SUPPLEMENTAL FEED ASSEMBLY FOR SHEET MATERIAL SPREADING MACHINE

[75] Inventors: Harold Grimm, Bronx; Ira Zuckerman, Rosedale, both of N.Y.

[73] Assignee: Panther Machine Corp., New York, N.Y.

[21] Appl. No.: 859,292

[22] Filed: Dec. 12, 1977

[51] Int. Cl.[2] ..... B65H 29/45

[52] U.S. Cl. ..... 270/31

[58] Field of Search ..... 270/30–31

[56] References Cited

U.S. PATENT DOCUMENTS 3,663,006 5/1972 Benson ..... 270/31

*Primary Examiner*—Edgar S. Burr
*Assistant Examiner*—A. Heinz
*Attorney, Agent, or Firm*—Edward F. Levy

[57] ABSTRACT

In a machine for spreading sheet material having a carriage movable over a table between fold retaining assemblies and with the carriage having a supply of sheet material, a positive drive roller and fold forming apparatus, a supplemental feed assembly comprising a driving connection which supplements the normal rotation of the positive drive roller to provide a selected amount of overfeed of the sheet material during the operation of the fold-forming apparatus, thereby preventing unwanted stretching of the sheet material.

7 Claims, 8 Drawing Figures

SUPPLEMENTAL FEED ASSEMBLY FOR SHEET MATERIAL SPREADING MACHINE

The present invention relates generally to devices for spreading layers of fabric sheet material one upon the other, and more particularly to a supplemental feed assembly which prevents unwanted stretching of the sheet material while forming folds at the ends of each of the layers.

The prior art includes examples of cloth-laying apparatus for spreading layers of sheet material one upon the other and forming transversely-extending folds at the ends of each of the layers. The apparatus for forming the transversely-extending folds generally includes one or more fold-forming bar around which the sheet material is guided to form a fold. The fold-forming bars, when in operation, increase the length of the path which the sheet material takes during its movement from a supply roll to the table. The fold-forming bars are disposed to deflect the line of feed of the sheet material thereby forming a fold and cooperating with fold-retaining means which hold the fold in place as a new layer is deposited on the table. An example of such apparatus is shown in our U.S. Pat. No. 3,173,798, entitled "Fold-Forming Assembly For Cloth Spreading Machine". An application of such apparatus may be found in the garment manufacturing industry where it is required to spread layers of fabric one on another on a suitable cutting table in an accurate manner wherein all of the layers have the same length and where the ends of each of the layers have accurately registering transverse folds disposed one upon another.

The type of apparatus described in the prior art performs adequately for fabric having a relatively low degree of stretch, such as denim. However, when used on easily stretchable fabric, such as knit fabric, the action of the fold-forming bars, which act to lengthen the path of feed of the fabric during the operation of forming a fold, causes undesirable stretching of the fabric. This stretching of the fabric at the folds of the layers leads to poor quality of the finished product since configurations cut from stretched portions of fabric relax after cutting, thereby causing distortion of the configurations. Alternatively, if the stretched portions of fabric are by-passed during the cutting operation, an objectionable wast of material occurs.

It is therefore a primary object of the present invention to provide an apparatus which will avoid the above disadvantages of cloth spreading apparatus of the prior art.

Another object of the present invention is to provide a supplemental feed apparatus for use on a sheet material spreading machine which provides supplemental feeding of sheet material while folds are being formed in the sheet material thereby preventing unwanted stretching of the material.

Still another object of the present invention is to provide an apparatus of the above type which is compact, and which is composed of a relatively small number of components each of which is economical of manufacture.

In accordance with the invention, there is provided in a machine for spreading sheet material having a carriage which moves back and forth along a table in opposed operative strokes between a pair of spaced fold-retaining members and having a fold-forming assembly, with the carriage having a supply of sheet material which is fed by a positive feed roller which is driven at the same speed as the carriage a supplemental feed assembly comprising an intermittent drive apparatus which acts to increase the speed of rotation of the positive drive rollers during the portion of the operating cycle during which the machine forms a fold in the sheet material.

The supplemental feed assembly includes a solenoid which is activated by a switch which contacts a portion of the fold-retaining assembly at the start of the fold-forming operation. The solenoid acts to rotate a shaft via a drive chain which engages a sprocket wheel mounted on a one-way clutch which is mounted on the shaft. The shaft is connected to the positive drive roller and the action of the solenoid causes a brief rotation of the shaft and the positive drive roller which supplements the normal rotation of the positive drive rollers and results in supplemental feeding of the sheet material.

After the completion of the supplemental feeding operation the drive chain is returned to its original position by a tension spring. The shaft includes a coupling comprising a pair of coupling blocks, the first of which is fixed on the shaft and the second of which is rotatably mounted on the shaft via a one-way clutch. The second coupling block is continuously driven by driving means when the machine is in operation. The coupling blocks each have a projecting pin with the two pins in driving engagement when the machine is in normal operation, with the coupling blocks driving the positive feed roller. The pins are driven apart when the solenoid causes supplemental rotation of the shaft.

Additional objects and advantages of the invention will become apparent during the course of the following specification when taken in connection with the accompanying drawings in which.

Figure 1:
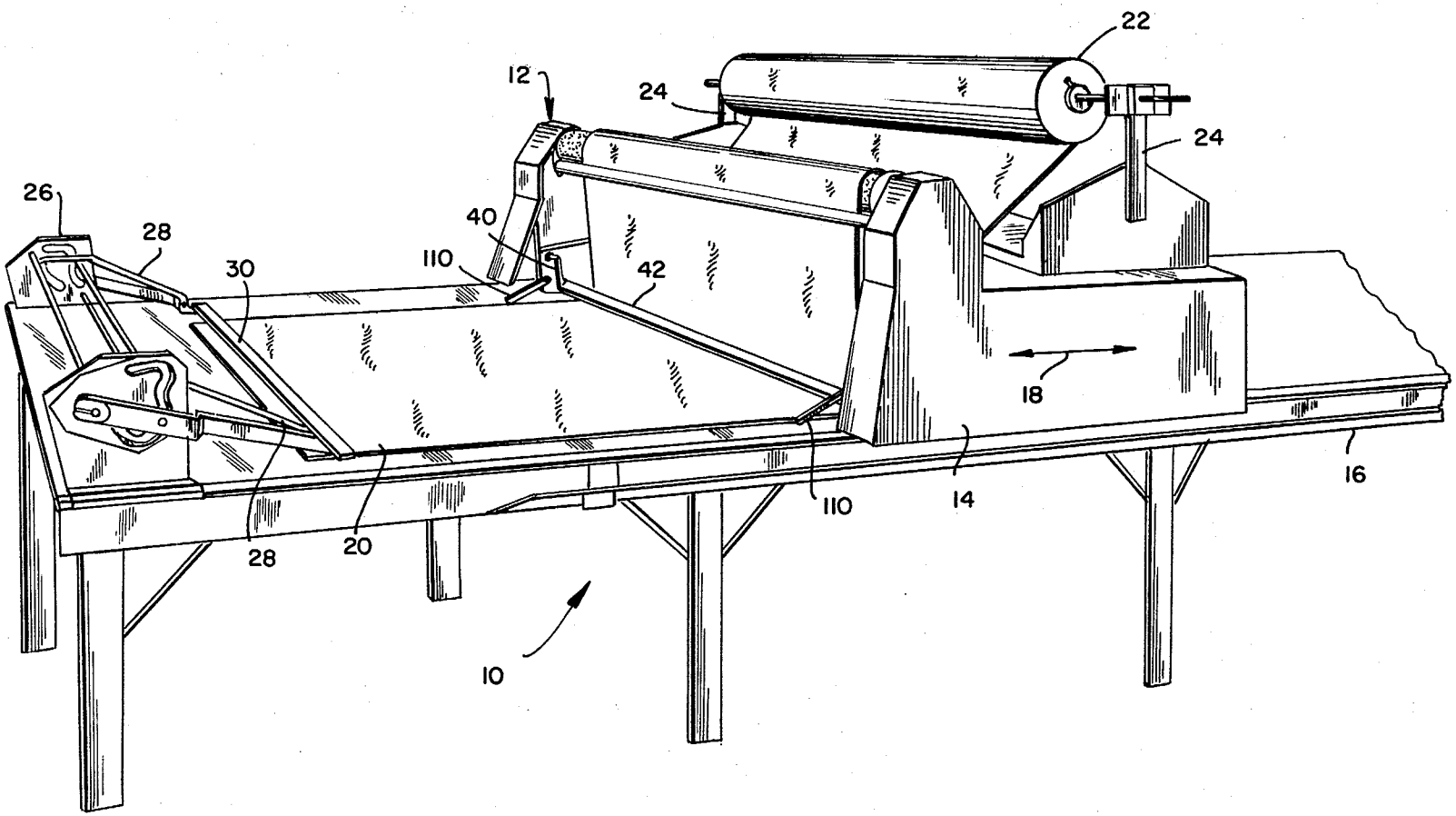
FIG. 1 is a fragmentary perspective view of a sheet material spreading machine which incorporates the supplemental feed assembly according to the present invention.

Referring in detail to the drawings, there is shown in FIG. 1 a sheet material spreading machine 10 which incorporates the supplemental feed assembly 12 made in accordance with the present invention. The sheet material spreading machine 10, apart from the supplemental feed assembly 12, is of conventional construction and will be described only to the extent required to explain the operation of the supplemental feed assembly 12. A carriage 14 is mounted on the upper surface of a table 16 and is adapted to move back and forth to the left and to the right as viewed in FIG. 1, and as indicated by the arrow 18, for the purpose of spreading sheet material 20 which is contained on a supply roll 22 which is rotatably mounted on uprights 24.

As the carriage 14 is advanced toward the left as viewed in FIG. 1, it approaches a fold-retaining member 26, which is of conventional construction and which is identical to a fold-retaining member (not shown) located at the right hand end of the table 16, and which is oppositely oriented. The fold-retaining member 26 has a pair of spaced arms 28 situated adjacent the side edges of the table 16 and connected at their free ends by a fold engaging and retaining bar 30 which extends transversely across the table 16. The arms 28 and the bar 30 are guided in a known manner for vertical motion.

Figure 2:
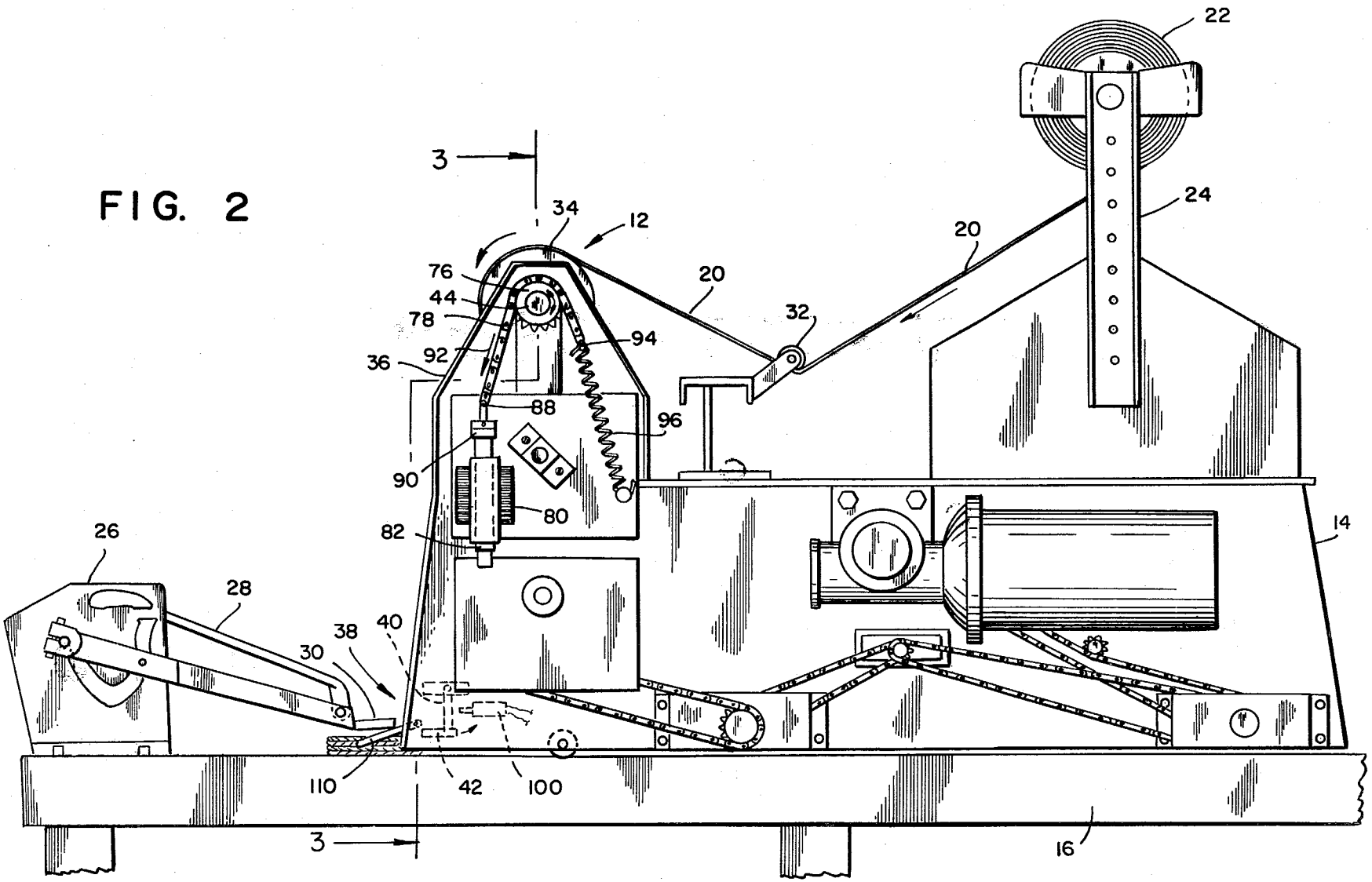
FIG. 2 is a longitudinal cross-sectional view of the sheet material spreading machine of FIG. 1, with the carriage shown approaching the end of one of its strokes.

Referring now to FIG. 2, it will be seen that the sheet material 20 is fed from the supply roll 22 and is guided around a transversely extending guide roller 32 which is mounted on the carriage 14 and over a transversely-extending positive feed roller 34, which is supported by a pair of spaced support bars 36, and then downwardly past a fold-forming assembly 38 to the table 16 where it is spread in layers. The fold-forming assembly 38 includes a pair of spaced links 40 and 41, each supporting a respective transversely-extending elongated fold-forming bar 42 and 43. The action of one of the links 40 or 41 during the operation of forming a fold in the sheet material 20 initiates the operation of the supplemental feed assembly 10 in a manner which will be presently described.

Figure 3:
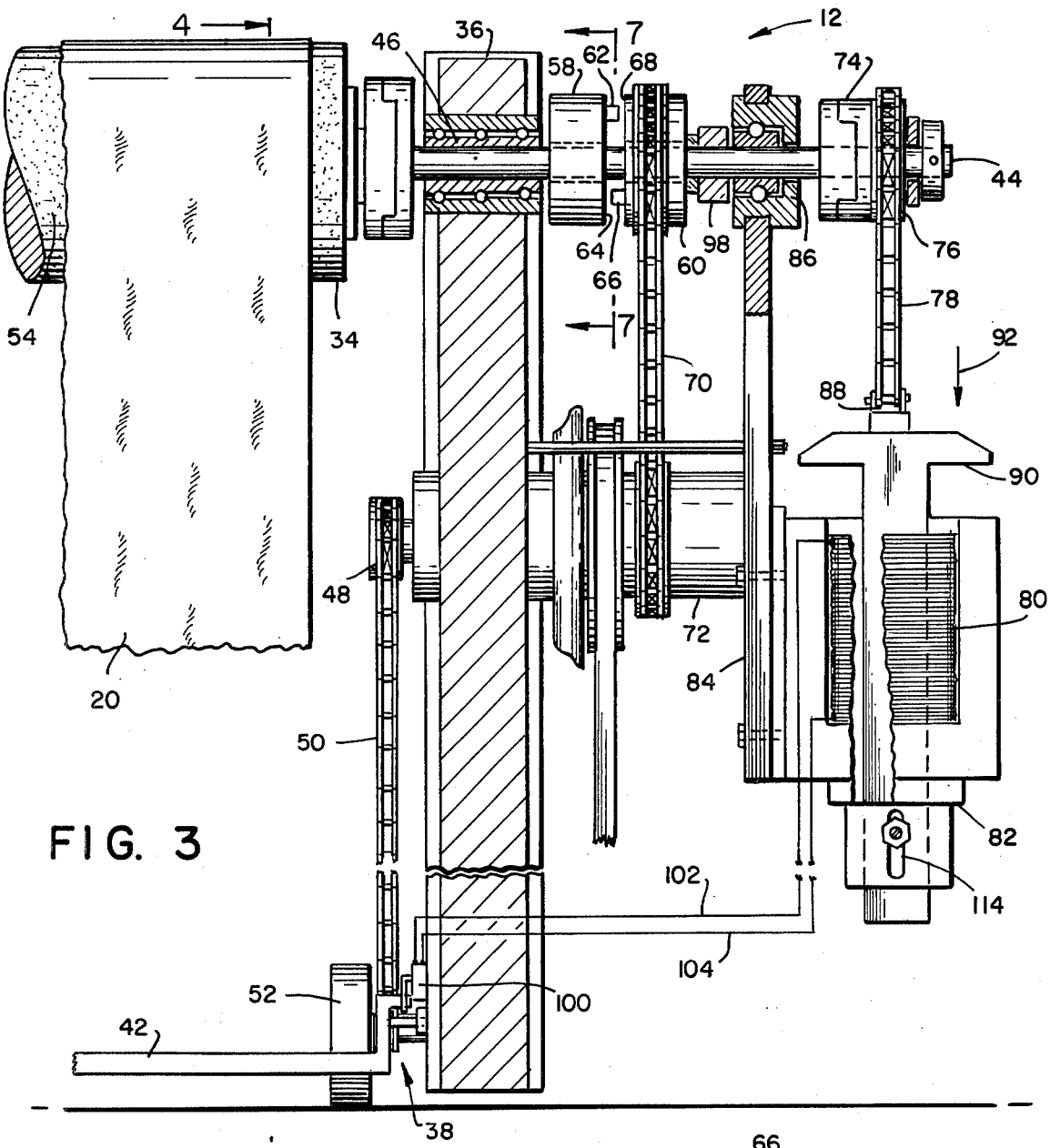
FIG. 3 is an enlarged section taken along the line 3—3 of FIG. 2.

Referring to FIG. 3, it will be seen that the positive feed roller 34 is rotatably mounted on a shaft 44 which is supported by a pair of bearings one of which is shown as the bearing 46 mounted in the support bar 36. The shaft 44 is operatively connected to a carriage wheel 52, through a Reeves drive pulley 72, containing one-way clutches, so that rotation of the carriage wheel 52 causes rotation of the shaft 44 at the same surface speed as wheel 52, except that shaft 44 turns constantly in one direction, regardless of the direction in which wheel 52 is rotating. A drive chain 50 connects the wheel 52 to a sprocket 48 connected to an extension shaft of the Reeves drive pulley 72. The surface 54 of the positive feed roller 34 has a relatively high coefficient of friction for the purpose of pushing off the sheet material 20 as the positive feed roller rotates. The sheet material portion 56 between the table 16 and the positive feed roller 34 is thus not placed under tension and is not subjected to unwanted stretching and distortion during travel of the machine carriage.

The supplemental feed assembly 12, according to the present invention, includes a first coupling block 58 which is fixed on the shaft 44 and a second coupling block 60 which is rotatably mounted on the shaft 44. A drive pin 62 is mounted on the surface 64 of the first coupling block 58 at a selected radius and projects toward the second coupling block 60. A drive pin 66 is mounted on the surface 68 of the second coupling block 60 at a radius equal to the radius of the drive pin 62 so that the drive pin 66 can engage drive pin 62 forming a driving connection in a manner which will be presently described. The second coupling block 60 includes an internally-mounted one-way clutch. A driving connection, such as a drive belt or a drive chain 70 connects the second coupling block 60 and the Reeves drive pulley 72 for rotation of the second coupling block 60 during operation of the sheet material spreading machine 10.

Figure 7:
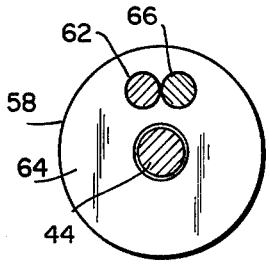
FIG. 7 is an enlarged section taken along the line 7—7 of FIG. 3 and showing the relative position of the drive pins of the coupling blocks during normal operation of the sheet material spreading machine.

The drive pin 66 on the second coupling block 60 normally engages the drive pin 62 on the first coupling block 58 as shown in FIG. 7, thereby driving the shaft 44 and the positive feed roller 34. The supplemental feed assembly 12 further includes a one-way clutch 74, mounted on the shaft 44, which is connected by driving connections such as a sprocket wheel 76 and a drive chain 78 to a solenoid 80. The solenoid 80 is mounted on a bracket 82 which is connected to an upright 84 which includes a bearing 86 supporting the shaft 44. The end 88 of the drive chain 78 is connected to the armature 90 of the solenoid 80 which is disposed for pulling the end 88 of the chain 78 in a downward direction as indicated by the arrow 92 in FIGS. 2 and 3. The end 94 of the chain 78 is connected to a tension spring 96 which in turn is connected to the carriage 14. A spacer 98 is mounted on the shaft 44 between the second coupling block 60 and the bearing 86.

Figure 4:
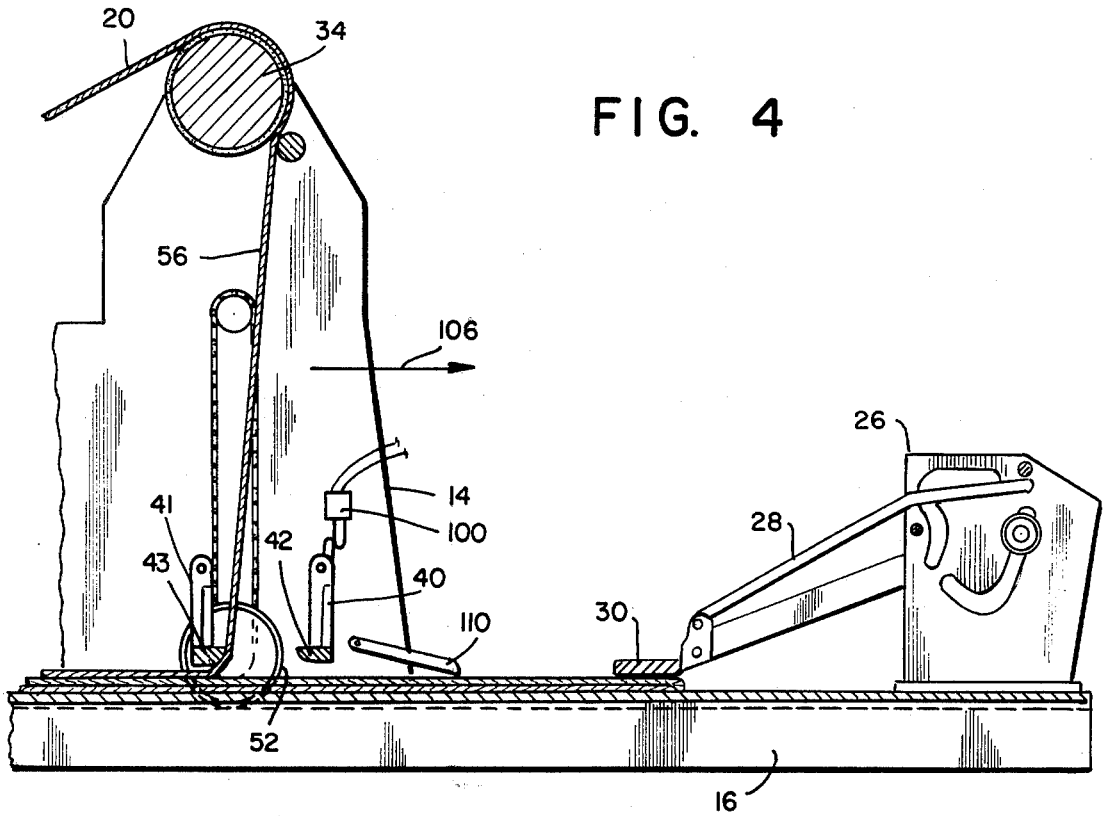
FIG. 4 is a section taken along the line 4—4 of FIG. 3, with the carriage shown approaching a fold-retaining assembly.
Figure 5:
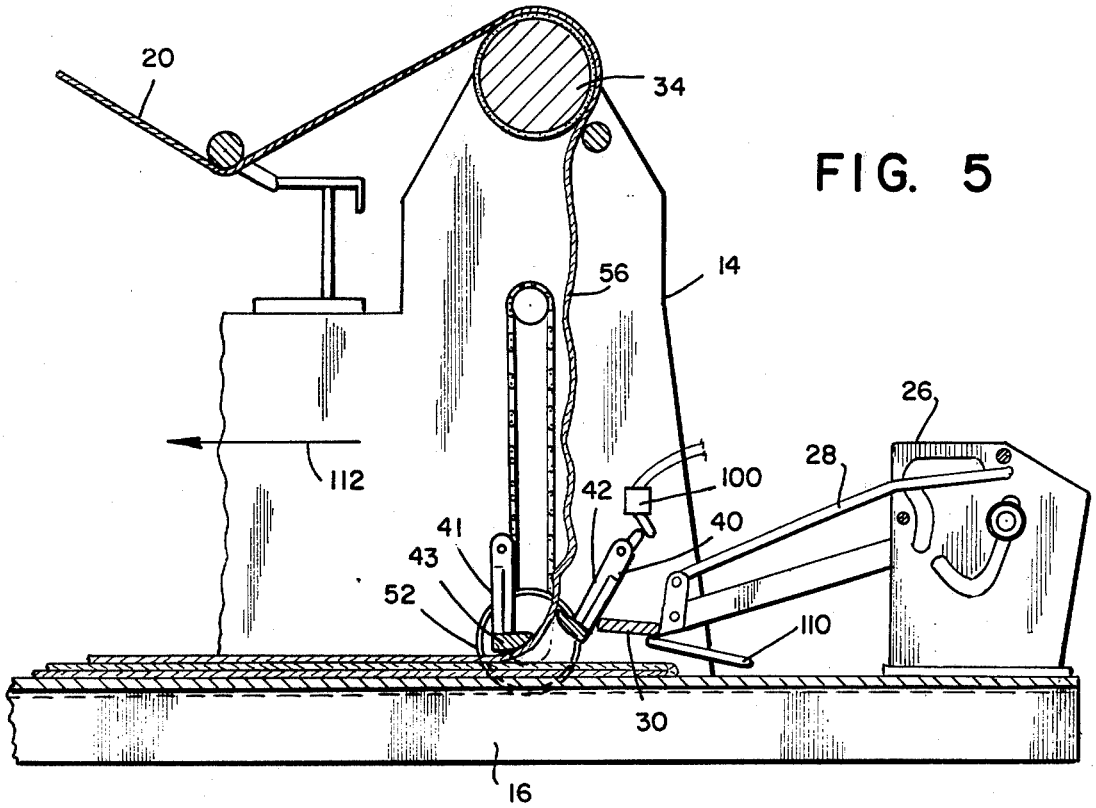
FIG. 5 is a sectional view similar to FIG. 4, but with the carriage shown in contact with the fold-retaining assembly which starts the operation of the supplemental feed assembly.

Referring to FIG. 4, it will be seen that when the carriage 14 is travelling in the direction of arrow 106, that is, toward the fold-retaining member 26, the portion 56 of the sheet material 20 extends downwardly between the spaced links 40 and 41 and engages the leading edge of the fold-forming bar 43 upon which bar 43 a fold will eventually be made. As the carriage 14 nears the fold-retaining member 26, the pivot link 110 mounted on the support bar 36 lifts the transverse bar 30 which then slides over the top of link 110 and engages the link 40. Upon further movement of the carriage, the engagement of the transverse bar 30 with the link 40 causes the lower end of link 40 to swing inwardly and upwardly, as shown in FIG. 5, to provide clearance for the transverse bar 30 to fall upon the fold-forming bar 43 and form a fold thereon, in the manner shown in FIG. 6. As the transverse bar 30 falls upon the fold-retaining bar 43, it would ordinarily exert a pulling force upon the sheet material portion 56 in order to enable the angular fold to be formed, thereby causing stretching of the material. The supplemental feed of the present invention is intended to eliminate this pulling force and prevent such stretching of material.

A switch 100 is mounted on the carriage support bar 36 and is positioned so that when the link 40 of the fold-forming assembly swings inwardly and upwardly, as shown in FIG. 5, the link 40 contacts and activates the switch 100. A similar switch (not shown) is also mounted behind the other link 41 for actuation thereby when the carriage is travelling in the opposite direction and engages the opposite fold-retaining member 26 at the other end of the table. Since the switches are identical, and are connected in the same manner to the supplemental feed apparatus, only a description of the operation of switch 100 will be made herein.

Figure 6:
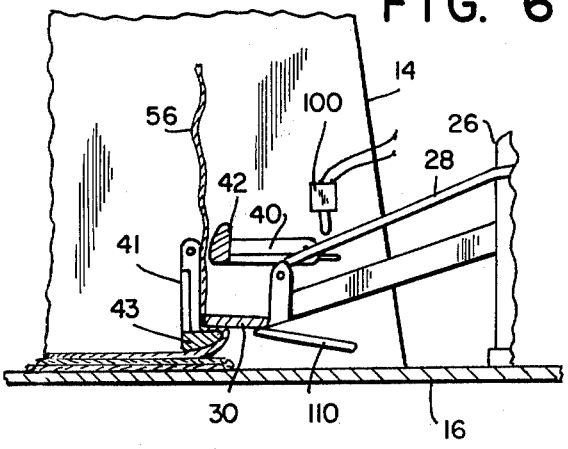
FIG. 6 is a sectional view similar to FIG. 4 but showing a fold formed on the fold-forming assembly and gripped by the fold-retaining assembly.

The switch 100 is connected to the solenoid 80 via leads 102 and 104. The operation of the supplemental feed assembly 12 will be described with reference to FIGS. 2–8. FIG. 4 shows the carriage 14 moving in the direction of the arrow 106 and approaching the fold-retaining member 26. During this time, the drive pins 62 and 66 are in engagement as shown in FIG. 7 and the positive feed roller 34 pushes off the sheet material 20 to form a layer 108 on the surface of the table 16. When the link 40 engages the transverse bar 30 and is swung upwardly, as shown in FIG. 6, the upper end of the link 40 engages the switch 100 which activates the solenoid 80, the latter pulling the chain 78 in the direction of the arrow 92 in FIG. 3. The motion of the chain 78 causes an additional or supplemental rotation of the shaft 44 which causes an additional amount of sheet material 20 to be fed by the positive feed roller 34 during the fold-forming operation, thereby avoiding unwanted stretching of the sheet material 20. This additional amount of sheet material is sufficient to enable the transverse bar 30 to form a fold in the sheet material upon fold-forming bar 43, as shown in FIG. 6, and then allows the bar 43 to drop to the table surface with the fold, without stretching the sheet material.

Figure 8:
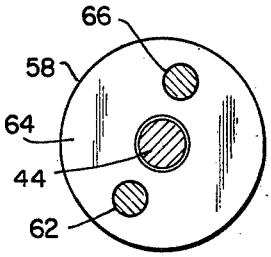
FIG. 8 is a section similar to FIG. 7, but showing the relative positions of the drive pins during the operation of the supplemental feed assembly.

During the overfeed or supplemental feed operation, the relative positions of the drive pins 62 and 66 are as shown in FIG. 8. The first coupling block 58, which is fixed on the shaft 44, rotates with respect to the second coupling block 60 as a result of the action of the solenoid 80 and the pin 62 is driven away from the pin 66. After the completion of the supplemental feed, the tension spring 96 returns the chain 78 to the original position occupied before the solenoid pulled the chain 78 downward. The one-way clutch 74 prevents rotation of the shaft 44 by the chain 78 while the tension spring returns it to its original position. The second coupling block 60 is continuously driven by the drive chain 70 and therefore continuously turns the pin 66 mounted thereon. After a short interval of time, the pin 66 catches up to the new position of the pin 62 and the pin 66 again bears against the pin 62 and drives the shaft 44 as previously described. By the time this occurs, the carriage 14 has reversed its direction of travel and is moving in the direction shown by the arrow 112 in FIG. 5. During the small interval of time during which the pin 66 catches up to the pin 62 the positive feed roller 34 and the shaft 44 do not rotate. This enables the sheet material spreading machine 10 to take up whatever slack is formed in the sheet material 20 during the operation of the supplemental feed assembly 12.

The amount of overfeed of the supplemental feed assembly 12 may be varied by adjusting the vertical position of the solenoid 80 using the slot 114 in the bracket 82.

The operation of the supplemental feed assembly 12 has been described with reference to FIGS. 4 and 5 which show the carriage 14 adjacent to the left hand fold-retaining member 26. It is to be understood that this has been done by way of example only and that the operation of the supplemental feed assembly 12 is the same as has been described above when the carriage 14 approaches the right hand fold-retaining member.

While a preferred embodiment of the invention has been shown and described herein, it is obvious numerous ommissions, changes and additions may be made in such embodiment without departing from the spirit and scope of the invention.

What is claimed is:

1. In a fabric spreading machine for spreading sheet material in superimposed layers on a table surface, and including a carriage which moves back and forth over said table surface in opposed operative strokes between a pair of spaced fold-retaining members, with said carriage having a fold-forming assembly, a shaft, and a positive feed roller mounted on said shaft for rotation therewith, for feeding a supply of sheet material carried by said carriage onto said table, and first drive means connected to said positive feed roller for continuously rotating the latter during said operative strokes with said sheet material fed at a rate corresponding to the speed of travel of said carriage;

a supplemental feed assembly comprising second, intermittent drive means connected to said shaft through a one-way clutch mounted on said shaft and operatively connected to said positive feed roller for intermittent additional rotation thereof to provide an overfeed of said sheet material as said carriage approaches and engages each of said fold-retaining members, actuating means mounted on said carriage and operatively connected to said intermittent drive means for actuating the latter in response to arrival of the carriage at that portion of each of said operative strokes in which the fold-forming assembly moves into contact with a respective fold-retaining member, and lost motion means mounted on said shaft for operatively connecting said first drive means to said positive feed roller and operable by said second, intermittent drive means, after the latter has turned said roller through said additional rotation to provide said overfeed of material, for disconnecting said feed roller from said first drive means for a selected period sufficient to take up slack of excess sheet material fed as said carriage commences movement in the opposite stroke, said lost motion means comprising a first coupling block rigidly mounted on said shaft, a second coupling block rotatably mounted on said shaft and spaced apart from said first coupling block, a first drive pin connected to said first coupling block and projecting toward said second coupling block, and a second drive pin connected to said second coupling block and projecting toward said first coupling block, said second drive pin being positioned to engage said first drive pin to form a driving connection therewith, said first drive means being connected to said second coupling block for rotating the latter.

2. A supplemental feed assembly in a fabric spreading machine according to claim 1 in which said first drive means includes a chain arrangement connecting a wheel of said carriage to said lost motion means through a one-way clutch assembly.

3. A supplemental feed assembly in a fabric spreading machine according to claim 1 in which said second, intermittent drive means comprises a solenoid mounted on said carriage and driving connections coupling said solenoid to said one-way clutch, and in which said actuating means comprises an electrical switch mounted on said carriage and operatively engagable by a movable portion of said fold-forming assembly, and electrical circuit means connecting said switch to said solenoid for operation of the latter to rotate said shaft and said positive feed roller in response to operation of said fold-forming assembly.

4. A supplemental feed assembly in a fabric spreading machine according to claim 3 in which said solenoid is connected by a chain to said one-way clutch mounted on said shaft.

5. A supplemental feed assembly in a fabric spreading machine according to claim 1 in which the first drive pin of said first coupling block is normally in engagement with said second coupling pin of said second coupling block, whereby said first drive means rotates said shaft and positive drive roller through the engaged coupling pins of said coupling blocks in response to travel of said carriage through a major portion of its operative strokes.

6. A supplemental feed assembly in fabric spreading machine according to claim 5 in which said second, intermittent drive means is connected to said first coupling block through said shaft, whereby operation of said second drive means rotates said first coupling block an additional distance relative to said second coupling block, causing said first coupling pin to move ahead of said second coupling pin, said first drive means thereafter rotating said second coupling block without rotating said shafts until said second coupling pin overtakes and engages said first coupling pin.

7. A supplemental feed assembly in a fabric spreading machine according to claim 6 in which said supplemental feed assembly also includes means for adjusting the mounted position of said solenoid relative to said shaft whereby to selectively vary the amount of overfeed produced by operation of said solenoid.

* * * * *